US009590301B2

(12) United States Patent
Pivit et al.

(10) Patent No.: US 9,590,301 B2
(45) Date of Patent: Mar. 7, 2017

(54) CALIBRATION OF ACTIVE ANTENNA ARRAYS FOR MOBILE TELECOMMUNICATIONS

(75) Inventors: Florian Pivit, Dublin (IE); Jan Hesselbarth, Zurich (CH)

(73) Assignee: Alcatel Lucent, Boulogne-Billancourt (FR)

( * ) Notice: Subject to any disclaimer, the term of this patent is extended or adjusted under 35 U.S.C. 154(b) by 579 days.

(21) Appl. No.: 13/635,828

(22) PCT Filed: Feb. 28, 2011

(86) PCT No.: PCT/EP2011/000956
§ 371 (c)(1),
(2), (4) Date: Nov. 16, 2012

(87) PCT Pub. No.: WO2011/113526
PCT Pub. Date: Sep. 22, 2011

(65) Prior Publication Data

US 2013/0057447 A1 Mar. 7, 2013

(30) Foreign Application Priority Data

Mar. 18, 2010 (EP) ..... 10360015

(51) Int. Cl.
*H01Q 21/00* (2006.01)
*H01Q 3/26* (2006.01)

(52) U.S. Cl.
CPC ..... *H01Q 3/267* (2013.01)

(58) Field of Classification Search
CPC ..... H01Q 21/00
(Continued)

(56) References Cited

U.S. PATENT DOCUMENTS 4,554,550 A 11/1985 Lopez
4,926,186 A 5/1990 Kelly et al.
(Continued)

FOREIGN PATENT DOCUMENTS

EP 0 452 799 A1 10/1991
EP 0 584 635 A1 3/1994
(Continued)

OTHER PUBLICATIONS

International Search Report for PCT/EP2011/000956 dated Jul. 29, 2011.

*Primary Examiner* — Dameon E Levi
*Assistant Examiner* — Andrea Lindgren Baltzell
(74) *Attorney, Agent, or Firm* — Fay Sharpe, LLP

(57) ABSTRACT

In order to calibrate in amplitude and phase the individual transceiver elements (4) of an active antenna array for a mobile telecommunications network, each transceiver element including a transmit and a receive path (8, 10) coupled to an antenna element (12), each transceiver element includes a comparator (100) for comparing phase and amplitude of transmitted or received signals with reference signals in order to adjust the characteristics of the antenna beam. In order to provide an accurate means of reference signal distribution, a feed arrangement distributes the reference signals and includes a waveguide (50) of a predetermined length which is terminated at one end (52) in order to set up a standing wave system along its length, and a plurality of coupling points (56) at predetermined points along the length of the waveguide, which are each coupled to a comparator of a respective transceiver element.

15 Claims, 5 Drawing Sheets

(58) Field of Classification Search
USPC ..... 343/853
See application file for complete search history.

(56) References Cited

U.S. PATENT DOCUMENTS

| | | | | |
|---|---|---|---|---|
| 5,187,486 | A | 2/1993 | Kölzer | |
| 5,337,059 | A | 8/1994 | Kölzer et al. | |
| 6,097,267 | A * | 8/2000 | Hampel | H01P 1/184 333/128 |
| 7,656,359 | B2 * | 2/2010 | Haziza | H01Q 13/00 343/772 |
| 2005/0256519 | A1 * | 11/2005 | Goble | A61B 18/042 606/34 |
| 2007/0001773 | A1 * | 1/2007 | Oxborrow | H01P 7/10 331/154 |
| 2008/0144689 | A1 * | 6/2008 | Crouch | H01Q 3/26 372/57 |
| 2009/0322610 | A1 * | 12/2009 | Hants | H01Q 3/2694 342/372 |

FOREIGN PATENT DOCUMENTS

| | | |
|---|---|---|
| JP | 2000-209024 | 7/2000 |
| JP | 2002-100919 | 4/2002 |
| JP | 2007-295368 | 11/2007 |

* cited by examiner

CALIBRATION OF ACTIVE ANTENNA ARRAYS FOR MOBILE TELECOMMUNICATIONS

FIELD OF THE INVENTION

The present invention relates to antenna arrays employed in mobile telecommunications systems, and in particular to the phase and/or amplitude calibration of RF signals in active antenna arrays.

BACKGROUND ART

In wireless mobile communications, active, or phased array, antenna systems are emerging in the market, which are used for beam steering and beam forming applications. Active antenna systems allow increase of network capacity, without increasing the number of cell sites, and are therefore of high economical interest. Such systems comprise a number of individual antenna elements, wherein each individual antenna element transmits RF energy, but adjusted in phase relative to the other elements, so as to create a beam pointing in a desired direction. It is essential for the functionality of the system to be able to measure, control and adjust the phase coherency of the signal being radiated from the various individual antenna elements of the antenna array.

In FIG. 1 a known active antenna system is depicted, formed from several individual transceiver elements 4. A digital baseband unit 6 is coupled to each transceiver element, and each transceiver element comprises a transmit path 8 and a receive path 10. Each path is coupled to an antenna element 12. The transmit path 8 processes a signal from baseband unit 6 and includes a digital to analog converter DAC, a power amplifier PA, and a Diplexer/Filter 15. The receive path 10 processes signals received from antenna element 12, and comprises Diplexer/Filter 15, a low noise amplifier LNA, and an analog to digital converter ADC.

Each transceiver element generates an RF signal which is shifted in phase either electronically or by RF-phase shifters relative to the other transceiver elements. Each antenna element thereby forms a distinctive phase and amplitude profile 14, so that a distinctive beam pattern 16 is formed. It is therefore necessary to align or calibrate all signal phases and amplitudes from the individual transceiver elements at the point where they are transmitted by the antenna elements. To align all transceivers, a common reference is required. The transmitted signal is then compared in phase and amplitude with the reference.

To provide a phase and amplitude reference, two different methods have been used:

1. The signal of one element of the array is used as reference and all other signals are adjusted so that the required coherency to the reference element is achieved. This method usually requires (depending on the size of the array and accuracy) very complex algorithms to mutually adjust the elements, because the adjustment relies on mutual coupling of the elements, which is weak for elements at larger distances. Or a factory-calibration is used, which is complicated to recalibrate if, e.g. during the operation of the array, any phase or amplitude changes in the RF-signal-generation and transmission occurs. This method also requires a dedicated receiver unit, which is able to receive the transmitted signals from the other antenna elements. If receive calibration is also required, a dedicated transmitter is needed for a test signal. The additional receiver and transmitter increase cost and the associated algorithms require extra computational resources.

2. A star-distribution network, wherein a reference is generated in a central unit, which is then distributed to all transceivers, and each transceiver is aligned with the reference. This method is the preferred ones for smaller arrays (number of elements≤10) due to the simpler algorithms required. Critical for the central reference generation calibration method is that the accuracy of the reference distribution is high. Each error in terms of phase or amplitude in the reference will be carried forward to the transmitted/received signal itself. To accurately distribute the phase reference, a centrally generated reference signal is split into a set number of signal paths. Each such path is connected to the respective reference signal input of each transceiver unit of the array by respective transmission lines, the transmission lines being of nominally equal length. This method suffers from three draw backs:

a) Each transmission line has to be of at least half the length of the array size. That means even if an element is located very close to the reference signal generator, it requires a long cable. This increases cost unnecessarily and the volume and weight of the network.

b) The number of transceiver elements is limited to the preset number of signal paths. The network has to be designed for a specific number of elements, which leads to inflexibility.

c) The mechanical accuracy of the transmission line lengths has to be great, that is the tolerances must be small, in view of the requirements for phase and amplitude accuracy of the array itself. For example, for a mobile communication base station antenna with eight to ten elements operating at a frequency of approx 2 GHz, the required phase accuracy is in the order of ±3° among elements. This corresponds to an approximate accuracy of the total line length of ±0.9 mm of a Teflon-filled 50 Ohm-coaxial cable with a total length of approx 700 mm (the array itself is approx 1400 mm long). To ensure this kind of accuracy in a mass production environment is expensive, especially if e.g. thermal expansion during the operation of the antenna and varying bending radii of the different lines within the antenna structure are also taken into account.

SUMMARY OF THE INVENTION

The present invention provides an active antenna array for a mobile telecommunications network, comprising a plurality of radio elements, each including a transmit and/or a receive path coupled to an antenna element, and each including comparison means for comparing phase and/or amplitude of transmitted or received signals with reference values in order to adjust the characteristics of the antenna beam, and including a feed arrangement for supplying reference signals of amplitude and/or phase, the feed arrangement including a waveguide of a predetermined length, which is coupled to a reference signal source, and which is terminated at one end in order to set up a standing wave system along its length, and a plurality of coupling points at predetermined points along the length of the waveguide, which are each coupled to a said comparison means of a respective said radio element.

In accordance with the invention, at least in a preferred embodiment, it is possible to overcome or at least reduce the above noted problems, and to provide an accurate distribution mechanism for phase and amplitude reference signals for calibration of active antenna arrays for mobile communications. The distribution mechanism in addition in a preferred embodiment is mechanically robust and cost-effective.

In the present invention, at least in a preferred embodiment, a reference source signal of phase and/or amplitude is coupled to a finite length of a transmission line, which is terminated such as to set up a standing wave within the transmission line length. As is well-known, in a length of transmission line or other waveguide terminated at one end with its characteristic impedance, radiated travelling waves will progress along the line and be absorbed in the terminating impedance. For all other terminations however, some radiation will not be absorbed, but be reflected from the end, and will set up a standing wave system, where the resultant wave amplitude changes periodically along the length of the waveguide (there will in addition be time variation of the voltage value at each point along the line as a result of wave oscillation/phase rotation). The amount reflected depends on the terminating impedance, and in the limiting cases of short circuit and open circuit, there will be a complete reflection. In other cases, there will be partial reflection and partial absorption.

The standing wave signal may be sampled at predetermined tapping or coupling points along the length of the line, which all have the same amplitude and phase relationships, or at least a known relationship of phase and amplitude. As preferred, such coupling points occur at or adjacent voltage maxima/minima within the standing wave, where the change of voltage with respect to line length is very small. Hence, the requirement for mechanical accuracy in positioning of the coupling point is much reduced as compared with the star-distribution network arrangement described above.

These coupling points may each be connected by a respective flexible short length of line of accurately known length to respective comparators in respective transceiver elements (more generally radio elements). Short lengths of flexible cable, all of the same length, may be formed very accurately as compared with the known star-distribution network above.

In a preferred embodiment, said waveguide may be formed as a plurality of sections of waveguide of predetermined length, interconnected by releasable couplings; this permits scaling to any desired size of antenna.

An application of the invention is for frequencies of the order of GHz, usually up to 5 GHz, that is microwave frequencies in the mobile phone allocated bands, where coaxial cable is generally used as a transmission line. However the invention is applicable to other frequencies, greater and smaller, and coaxial cable may be replaced by other waveguide and transmission line constructions such as hollow metallic waveguides, tracks on a printed circuit, or any other construction.

BRIEF DESCRIPTION OF THE DRAWINGS

A preferred embodiment of the invention will now be described, by way of example only, with reference to the accompanying drawings, wherein.

DESCRIPTION OF THE PREFERRED EMBODIMENT

In the following description, where reference is made to the transmit path, it will be appreciated the invention can be used in the same way to provide a reference for the receive path. The invention is applicable both to transmit and receive cases.

Figure 1:
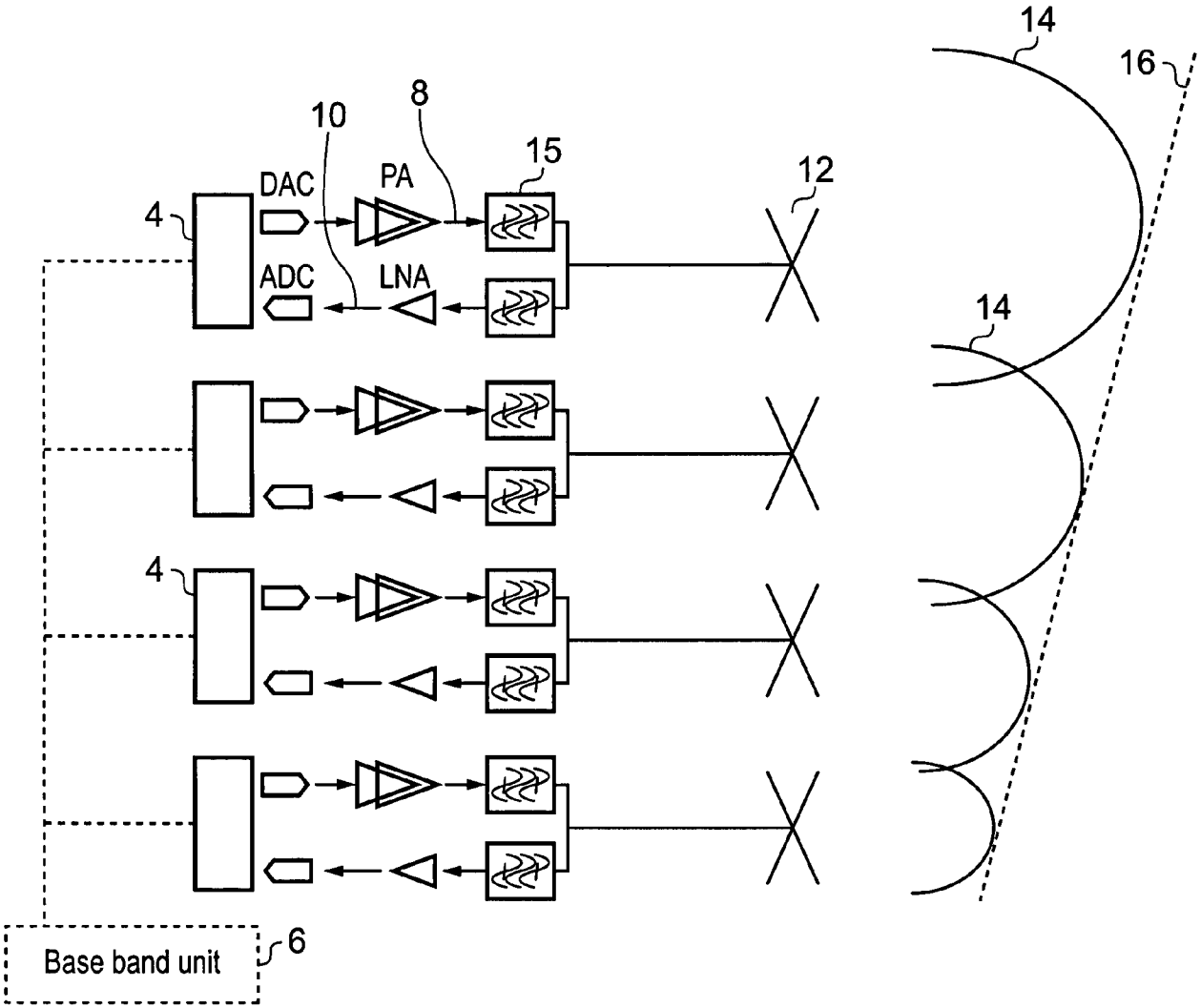
FIG. 1 is a schematic diagram of a known active antenna array comprising a number of transceiver elements.
Figure 2:
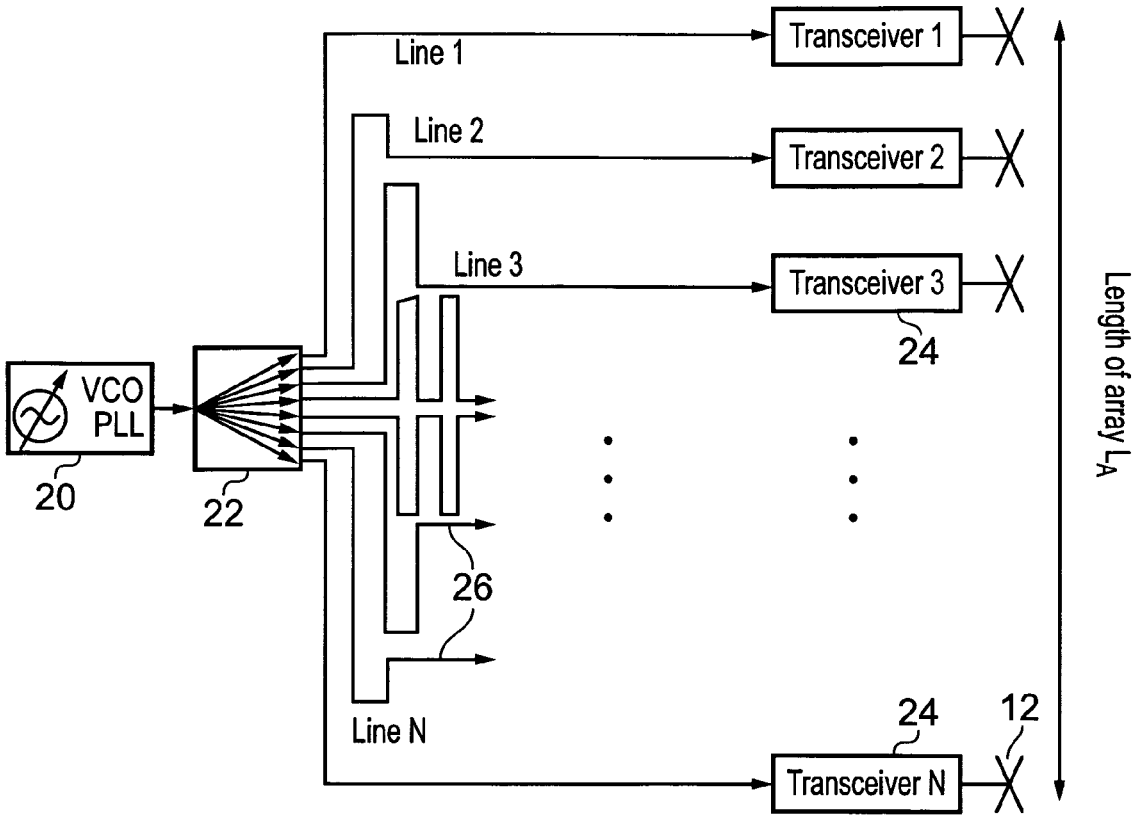
FIG. 2 is a schematic diagram of a means of distributing a reference signal to respective transceivers of an active antenna array, incorporating the known star-distribution network.
Figure 3:
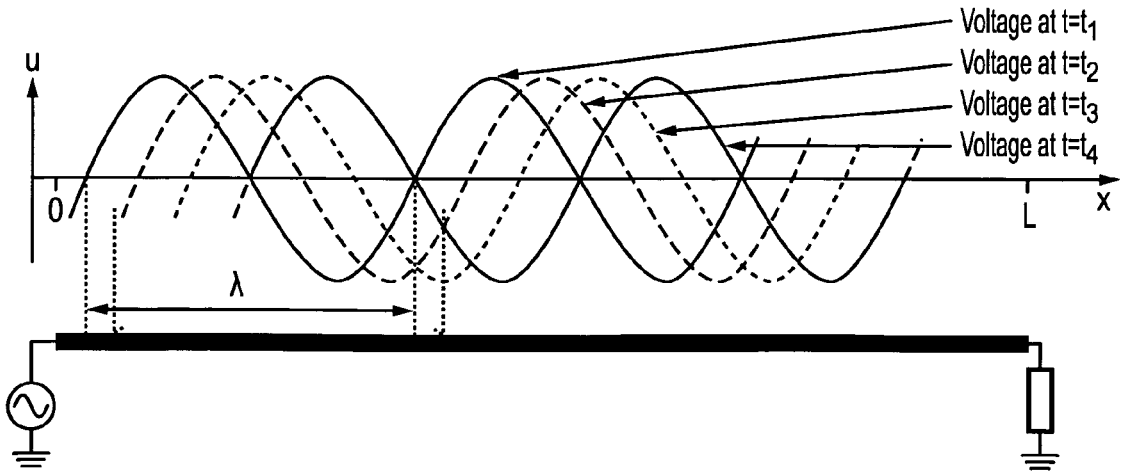
FIG. 3 is a schematic diagram of progression of a travelling electromagnetic wave along a transmission line length, having its free end terminated with a matching impedance.

Referring to FIG. 2, this shows a means of distributing a reference signal of phase and amplitude to the individual transceivers of an active antenna array. A centrally generated reference signal 20 (VCO PLL) is split in an N-way-power divider 22 (1:N-splitter) and connected to the reference input of each transceiver unit 24 by respective transmission lines 26 of equal length l. Length l is nominally equal to half the length of the array $l_A$. This forms the known star-distribution network, and any change of the line length results in a change of the phase length, giving rise to the disadvantages noted above. This is due to the travelling nature of the wave propagation on the line: the phase change $\Delta\phi$ is proportional to the length $\Delta l$ which the wave travels along the line: $\Delta\phi=(360/\lambda line)\Delta l$, where $\lambda$ is the wavelength of the radiation in the transmission line. If one looks at a travelling wave at a certain snap-shot in time, the phase changes with the position along the transmission line, as indicated in FIG. 3. In FIG. 3, voltage values are shown existing along the line at time intervals $t_1$-$t_4$. As is well known the measured voltage value is dependent on the amplitude A and phase $\phi$ of the electromagnetic wave, and in the travelling wave of FIG. 3, the measured voltage will vary, with time, at each point on the line between +A and −A. In FIG. 3, the line length is terminated with the matching impedance of the transmission line, so that all the energy of the travelling wave is absorbed. If however a line length is terminated with an impedance other than a matching impedance, then a standing wave system may be set up.

Figure 4:
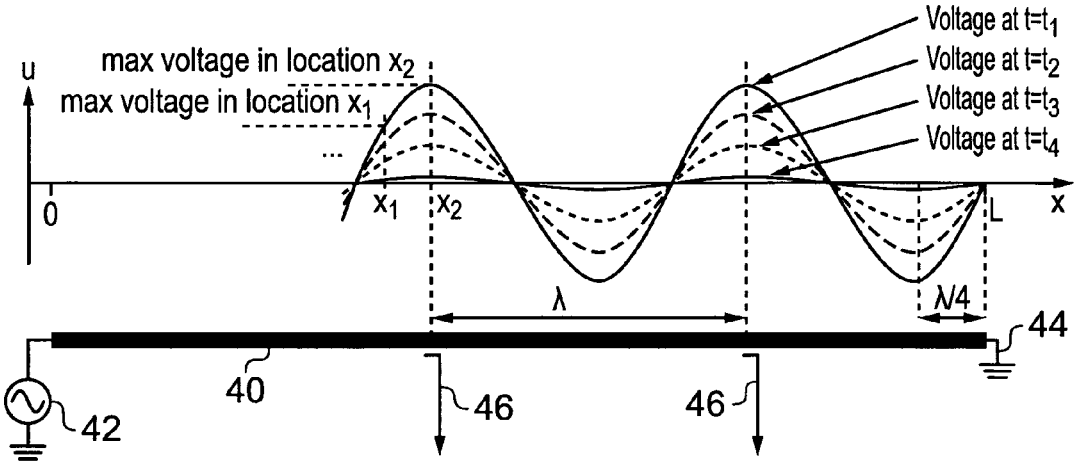
FIG. 4 is a schematic diagram of a standing electromagnetic wave along a transmission line, which has its free end terminated with a short circuit.

A standing wave arrangement is shown in FIG. 4. Such a standing wave can be generated along a line 40 by feeding it with a signal 42 from one end and shorting the signal at the other end 44. This short enforces a voltage-null at the end of the line. The same energy that travels along the line is fully reflected at the short and travels backwards towards the source. If the line is lossless (or reasonable low loss), this leads to a standing wave on the line. Thus, the voltage value at any point along the line now depends on time, but the phase of the wave does not vary along the line, rather the amplitude A of the electromagnetic wave varies cyclically along the length of the line, between maxima and minima, (positive and negative peaks), the maxima being spaced apart one wavelength λ of the wave, as shown. The first minimum occurs at a distance of λ/4 from the shorted end. At any given point along the line e.g. ×1 and ×2 the amplitude is different. The maximum voltage occurs at the same point in time as the minimum.

If the voltage on the line is now sampled by couplers 46 with a low coupling coefficient in order not to interfere with the standing wave, then the maximum at each coupler output occurs at the same time (even they may differ in amplitude). If it ensured that each coupler is spaced in a distance of 1λ, where λ is the wavelength of the radiation in the transmission line, then it is also ensured, that the amplitude at each coupler output is equal. If different amplitudes are desired, not necessarily equal, other distances than λ can be chosen.

In accordance with the invention, this arrangement of couplers attached to a line having a standing wave, may be used to transmit an amplitude and phase reference signal to the individual antenna elements of an active array system. Each coupler is attached to a respective transceiver by a short length of cable, of accurately known length. A primary advantage of this arrangement is that it avoids the strict requirements of mechanical accuracy of the star distribution arrangement of FIG. 2. To minimize the amplitude difference between coupling or tapping points, it is desirable to space the couplings in a distance of d=(Nλ+λ/4) from the shorted end; this places each coupling in a voltage-peak of the standing wave. Since the voltage distribution along the line follows a sinusoidal function, and the derivative of the sinusoidal function near the maximum/minimum value is zero, the sensitivity of the amplitude of the coupled signal to the physical position of the coupling point is minimal.

This arrangement overcomes shortcomings of the star-distribution arrangement, since the reduced dependence of the phase reference on the physical location of the coupling point along the line reduces the manufacturing cost and increases the accuracy of the system according to the invention as compared to a star-network. The signal may be transported from the coupling port to the reference comparator in the respective transceiver by a much shorter cable (e.g. in the order of several cm instead of several ten cms of the star network) and therefore be manufactured much more precisely. Due to the shorter cable lengths, the costs of the cables/line between the reference-line and the comparator are also reduced. The dependence of the amplitude of the coupled signal is minimized by placing the coupling ports at distances d=(Nλ+λ/4). For example, at 2 GHz and a Teflon filled line, a misplacement of the coupling point from the voltage maximum of +/−5 mm corresponds to a shift of 16.8°. With cos(16.8°)=0.95 this reduces the coupled amplitude by 20*log(0.95)=0.38 dB, which is about half of the permitted tolerance in amplitude accuracy for mobile communication antennas. Therefore the required mechanical accuracy has been reduced from a sub-mm-level tolerance to a level of several mm tolerance. It is much easier to achieve a sub-mm- or mm-accuracy on a short connection line between the standing wave line and the transceiver than on a line which is orders of magnitude longer, as in a star-network.

Figure 5A:
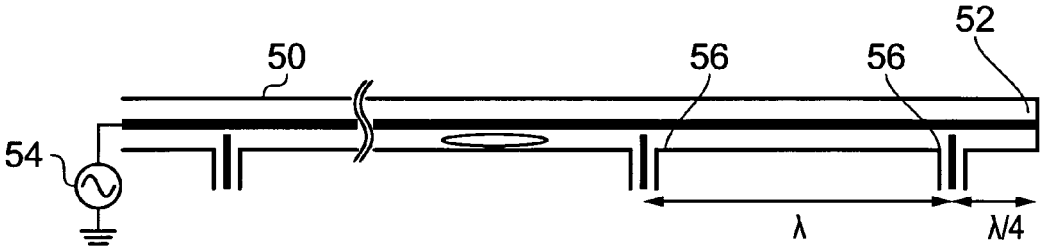
FIGS. 5*a*, 5*b*, and 5*c* are diagrammatic views of a length of transmission line with coupling points formed by capacitive coupling ports, for use in a preferred embodiment of the invention.
Figure 5B:
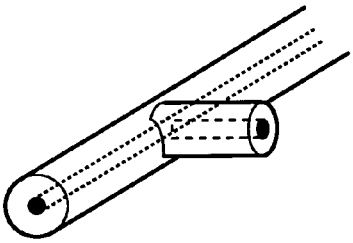
Figure 5C:
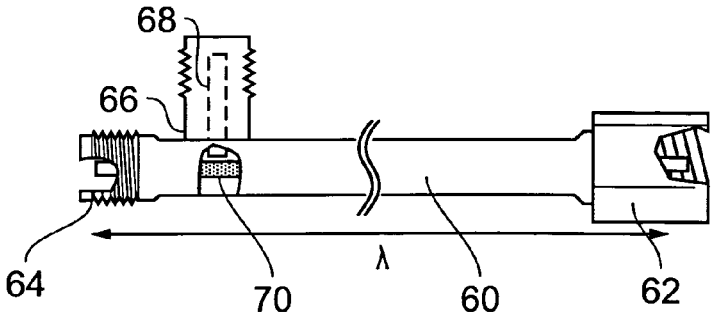

In FIGS. 5*a*, 5*b*, and 5*c* a preferred form of coaxial line is shown, which is incorporated a distribution arrangement for amplitude and phase reference signals according to the invention. In FIG. 5*a*, a transmission line, which is a coaxial line 50 with a shorted free end 52, is coupled to a reference source 54. The line has a series of spaced capacitive coupled coaxial coupling or tapping ports 56. A perspective view of a coupling port is shown in FIG. 5*b*. In FIG. 5*c*, a part-sectional view of a physical implementation of the transmission line is shown, comprising a length of air-filled coaxial line 60, which has a length equal to one wavelength λ of the transmission signal (a 2 Ghz signal has a wavelength of the order of 15 cm in free space). One end has a male coupling connector 62, and the other end a female coupling 64, for coupling to identical sections of coaxial line, in order to provide a composite line of desired length. The length 60 has a capacitive coupling port 66, having an electrode pin 68 which is adjustable in its spacing from a central conductor 70. The coupling coefficient can be tuned to a desired value by the length of the coupling pin protruding into the standing wave line.

In the illustrated case of the standing wave line filled with air, the distance between the ports 56 is λ0=c0/f with λ0 being the wavelength in free space. In antenna arrays the distance of antenna elements is usually between 0.5 λ0 and 1λ0, so that no gratings lobes occur in the array-pattern. In mobile communication antenna arrays this distance is usually in the order of ~0.9λ0. It is beneficial, that the distance between the coupling-ports for the reference signal matches the element distance, so the length of the wave guide that connects the coupling ports with the comparator-input is minimized. This is possible with the invention, by adapting the effective dielectric permittivity ∈eff used in the standing wave line such, that the physical length lc between the couplings equals approximately the element distance d between the antenna elements: 0.9λ0=d≈λ0/(square root (∈eff)). This is possible by using e.g. foam-material in the coaxial line as a dielectric and adjusting the dielectric permittivity by the density of the foam.

Figure 6:
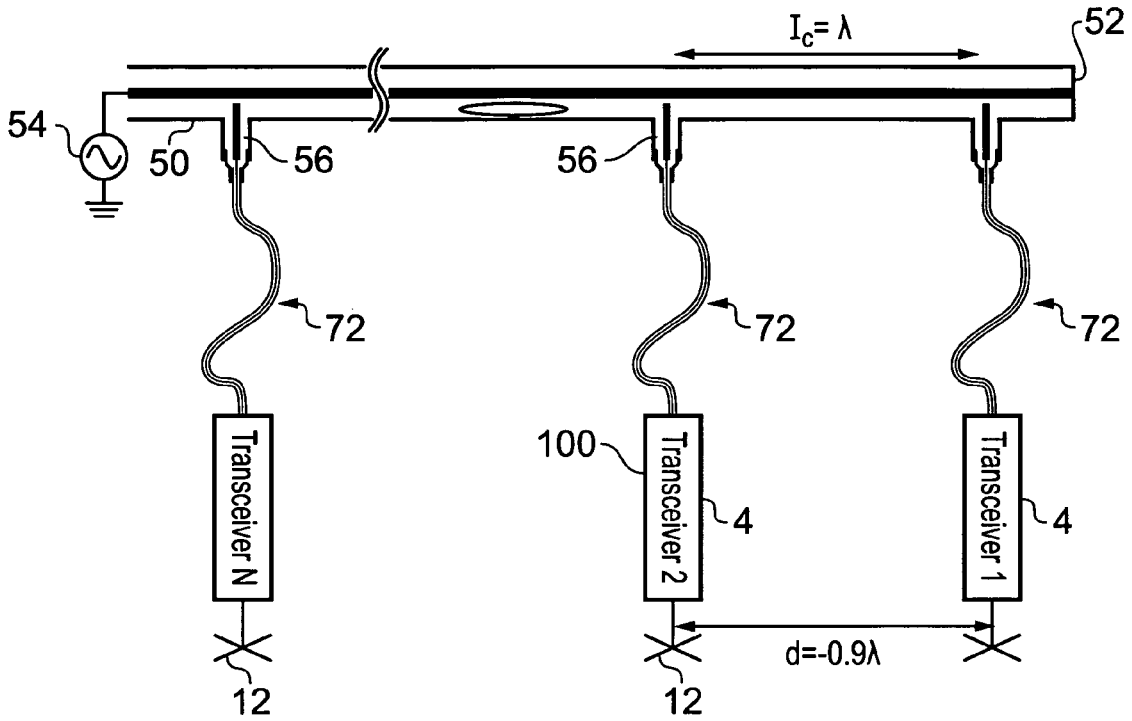
FIG. 6 is a schematic view of a feed arrangement of a reference signal to transceiver elements of an active antenna, in accordance with a preferred embodiment of the invention.

FIG. 6 shows a preferred embodiment of a distribution arrangement for reference signals of amplitude and phase to an active antenna system. The embodiment incorporates the coaxial line of FIG. 5, and similar parts to those of earlier Figures are denoted by the same reference numeral. In this embodiment the coupling or coupling ports 56 are separated by an effective distance of 0.9λ, and each coupling port 56 is connected by a short (of the order of a few cms, and short in relation to the length of line 50) flexible coaxial cable 72 to a respective transceiver (radio) element 4, which includes a comparator 100 and which is coupled to an antenna element 12. The lengths of the cables 72 are precisely manufactured to be equal.

Figure 7:
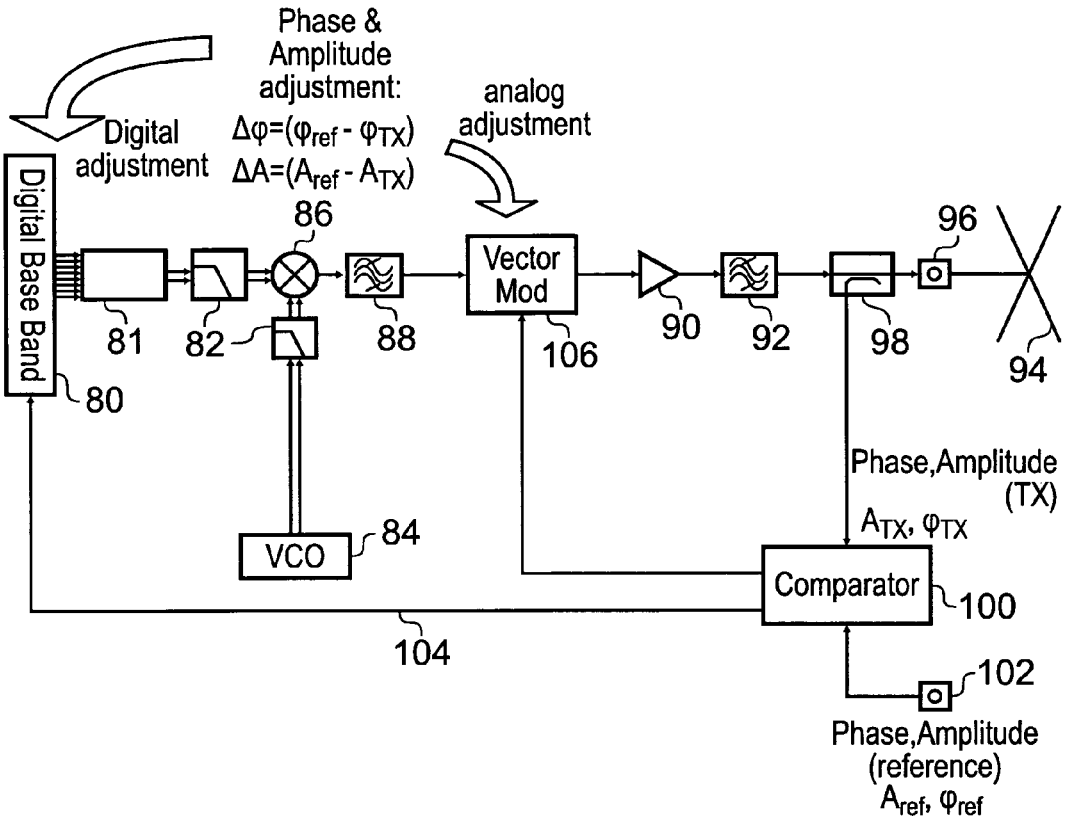
FIG. 7 is a schematic block diagram of a means for phase and amplitude adjustment within a transceiver element of the active array of FIG. 6.

The arrangement for processing the phase and amplitude reference signal within a transceiver (radio) element is shown in FIG. 7. A Digital baseband unit 80 provides signals, which include digital adjustment data, to a DAC 81, which provides a transmission signal for up-conversion in an arrangement comprising low-pass filters 82, VCO 84, mixer 86, and passband filter 88. The up-converted signal is amplified by power amplifier 90, filtered at 92, and fed to antenna element 94 via an SMA connector 96. To achieve phase calibration and adjustment, a directional coupler 98 senses the phase and amplitude A, ψ of the output signal. This is compared in a comparator 100 with phase and amplitude references $A_{ref}$, $\psi_{ref}$ at 102, to provide an adjustment value 104 to base band unit 80. Alternatively, if analog adjustment is required, a vector modulation unit 106 is provided in the transmission path. Thus, the comparator output 104 is fed back either to a digital phase shifter and adjustable gain block 80 or an analog phase shifter and gain block 106, to adjust the phase and amplitude of the transmitted signal until its phase and amplitude matches the reference value.

The arrangement of capacitive coupling points of FIG. 5, that is simple envelope detectors for the standing wave detection, may leave a 180° phase ambiguity. This ambiguity may be resolved by employing two similar standing wave lines, working with same frequency signals, but fed with, e.g., 90° phase difference (i.e., T/4 time difference). Then, detection can comprise using two detectors against ground, or using one detector between the two lines.

An advantage of the distribution means of preferred embodiments of the present invention is that it is scalable: the line can be designed as a single mechanical entity, or as a modular system, which is composed of several similar elements, which can be connected to each other. If more coupling points are required, the line length is increased by simply adding more segments.

Figure 8:
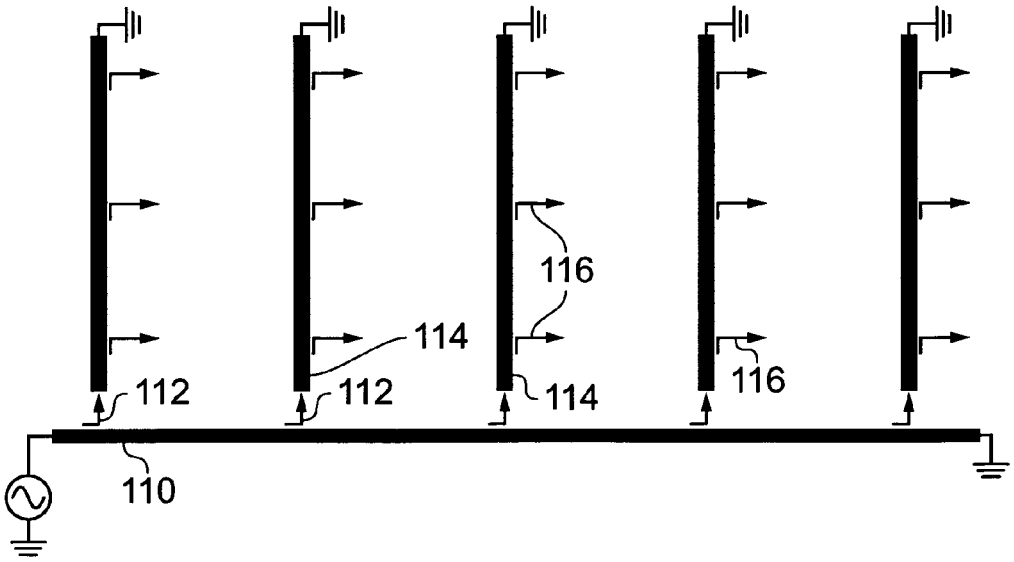
FIG. 8 is a schematic diagram of a modification of the preferred embodiment, forming a distribution arrangement for 2-D arrays.

In a modification, a distribution system for 2-dimensional arrays is provided. This is shown in FIG. 8, where a first line 110, as shown in FIG. 5, is coupled at each coupling point 112 to further coaxial lines 114, each line 114 being disposed at right angles to line 110, and each line 114 being as shown in FIG. 5 and having further coupling points 116. Coupling points 116 are connected to respective transceiver elements of a two dimensional active array.

In a further modification, by choosing a symmetrical implementation of the coupling points about the mid-point of the standing wave line, the accuracy can be improved further. Any error occurring in phase or amplitude is now symmetrical about the center of the array. If any phase or amplitude error occurs now along the reference coupling points (e.g. due to aging effects of the line), the symmetry of the generated beam is nevertheless ensured and no unwanted beam tilt effect occurs. Further, a temperature gradient along an active antenna array does not affect phase accuracy of the signals distributed to the respective antenna radiator modules. In practical operation, the uppermost antenna can easily experience an ambient temperature 20-30 degrees higher than the one of the lowest element. This can cause a few electrical degrees phase shift difference in a coaxial cable.

Thus the mechanism of the invention, at least in its preferred embodiment, overcomes the noted shortcomings of the prior art and may provide the following advantages:

Scalability (in 1D and 2D). The invention may therefore be ideal for the design of antenna arrays of varying sizes, depending on the required gain, output power and beam width of the system.

The required mechanical accuracy may be reduced theoretically completely if it is used for phase reference distribution. In cases where it is used also as an amplitude reference, the required mechanical accuracy is decreased from a sub-mm-level to a level of several mm.

The cost, weight and volume of the preferred form of reference distribution of the invention is reduced as compared to the prior art.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. An active antenna array for a mobile telecommunications network, comprising a plurality of radio elements including a transmit and/or a receive path coupled to a respective antenna element, and including a comparator configured to compare phase of transmitted or received signals with reference values in order to adjust the characteristics of the antenna beam, and including a feed arrangement configured to supply reference signals of phase, the feed arrangement including a waveguide of a predetermined length, which is coupled to a reference signal source, and which is terminated at one end in order to set up a standing wave system along its length, and a plurality of coupling points at predetermined points along the length of the waveguide, which are coupled to a comparator of a respective said radio element.

2. An array as claimed in claim 1, wherein said waveguide comprises a length of coaxial cable.

3. An array as claimed in claim 2, wherein said coupling points comprise capacitive coupling ports.

4. An array as claimed in claim 3, wherein the capacitive coupling ports are adjustable in order to adjust the coupling coefficient with the central conductor of the coaxial cable.

5. An array as claimed in claim 2, wherein the coaxial cable has a dielectric filling which may be adjusted in characteristics to alter an electromagnetic wave in a line.

6. An array as claimed in claim 1, wherein the coupling points are spaced apart by a distance of equal to or less than $1\lambda$, where $\lambda$ is the wavelength in free space of the reference signal.

7. An array as claimed in claim 6, wherein the coupling points are spaced apart by a distance of about $0.9\lambda$, where $\lambda$ is the wavelength in free space.

8. An array as claimed in claim 1, wherein the waveguide comprises a plurality of waveguide sections of predetermined length, interconnected by releasable couplings.

9. An array as claimed in claim 1, wherein the coupling points are located at or adjacent a voltage maximum or minimum in the standing wave system.

10. An array as claimed in claim 1, wherein the coupling points are spaced from the terminated end by a distance $d=(N\lambda+\lambda/4)$, where $\lambda$ is the wavelength in the waveguide.

11. An array as claimed in claim 1, wherein the terminated end comprises a short circuit.

12. An array as claimed in claim 1, wherein the couplings points are connected to a comparator by a coupling length of waveguide which is short in relation to the predetermined waveguide length.

13. An array as claimed in claim 1, wherein the array is two dimensional and includes a further plurality of waveguides, wherein at least one waveguide of said further plurality has an end which is not terminated coupled to a respective coupling point of said first-mentioned waveguide, said first mentioned waveguide extending in a different direction to that of said further plurality of waveguides.

14. An array as claimed in claim 1, wherein the feed arrangement includes a second waveguide of a predetermined length which is terminated at one end in order to set up a standing wave system along its length, and a plurality of coupling points at predetermined points along the length of the waveguide, which are coupled to a comparator of a respective said radio element, wherein the waves in the first and second waveguides have predetermined time phase difference.

15. An array as claimed in claim 1, wherein the coupling points of the waveguide are symmetrically arranged about the mid-point of the length of the waveguide.

* * * * *